US006650858B2

(12) United States Patent
Bessho

(10) Patent No.: US 6,650,858 B2
(45) Date of Patent: Nov. 18, 2003

(54) DEVELOPING APPARATUS FEATURING FIRST AND SECOND DEVELOPING SYSTEMS

(75) Inventor: Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/184,876

(22) Filed: Jul. 1, 2002

(65) Prior Publication Data

US 2003/0012587 A1 Jan. 16, 2003

(30) Foreign Application Priority Data

Jun. 29, 2001 (JP) ..... 2001-198393

(51) Int. Cl.[7] ..... G03G 15/09
(52) U.S. Cl. ..... 399/267; 430/106.1; 430/111.3
(58) Field of Search ..... 399/267, 269, 399/259, 298, 226, 222; 118/689; 430/105, 106.1, 111.1, 111.3, 111.31, 111.41, 107.1

(56) References Cited

U.S. PATENT DOCUMENTS 3,987,756 A * 10/1976 Katayama et al. ..... 399/227
5,853,937 A * 12/1998 Asanae et al. ..... 430/111.41
6,475,687 B2 * 11/2002 Hayashi et al. ..... 430/106.1

FOREIGN PATENT DOCUMENTS

JP 59-2056 1/1984
JP 4-47825 8/1992
JP 5-40406 2/1993
JP 9-211989 8/1997

OTHER PUBLICATIONS

Abstract for corresponding Publication No. 59–078377.

* cited by examiner

*Primary Examiner*—Sophia S. Chen
(74) *Attorney, Agent, or Firm*—Fitzpatrick, Cella, Harper & Scinto

(57) ABSTRACT

A developing apparatus includes a first developing system for developing a latent image formed on an image bearing member with a first developer including magnetic toner. The first developing system includes a first developer carrying member for carrying and feeding the first developer to the image bearing member and a first magnetic field generating device disposed in the first developer carrying member. The developing apparatus further includes a second developing system develops a latent image formed on the image bearing member with a second developer including a magnetic carrier and non-magnetic toner while the developer contacts the image bearing member. The second developing system includes a second developer carrying member for carrying and feeding the developer to the image bearing member and a second magnetic field generating device disposed in the second developer carrying member. A magnetization intensity Mσ ($Am^2/kg$) of the magnetic toner in an external magnetic field of 795.8 (kA/m) and a magnetization intensity Cσ ($Am^2/kg$) of the magnetic carrier in the same external magnetic field, satisfy the following inequalities:

$$35 < C\sigma(Am^2/kg) < M\sigma(Am^2/kg) \times 1.7.$$

16 Claims, 5 Drawing Sheets

DEVELOPING APPARATUS FEATURING FIRST AND SECOND DEVELOPING SYSTEMS

FIELD OF THE INVENTION AND RELAY ART

The present invention relates to a developing apparatus usable with an image forming apparatus for forming an image through an electrophotographic type, an electrostatic recording type or the like, more particularly to a developing device usable with an image forming apparatus such as a copying machine, a printer, a facsimile machine or the like.

In an image forming apparatus which forms color images, four color developers (yellow, magenta, cyan and black developers) are ordinarily used. An image forming apparatus forming color images by superimposing different color toner images is known in which the plurality of developing devices are provided for a single image bearing member. In the case that a color image forming apparatus is used also as a monochromatic copying machine, the frequency of use of the black developing device is very high. Therefore, it is particularly effective to use a one component jumping developing method (jumping developing method with one component developer) of the black image development. In consideration of this, two component developing method (developing method with two component developer) is used with nonmagnetic toner for development with color development materials such as magenta, cyan, yellow and the like, whereas the one component jumping developing method is used with one component magnetic developer, as is known.

However, with the image forming apparatus having such a structure, magnetic carrier particles contained in the two component developer may be introduced to the developing device for the single component developer with the image forming operations with the possible result of reduction of the image density due to the one component developer. To avoid such a problem; various attempts have been made.

For example, Japanese Laid-open Patent Application Sho 59 2056 proposes that carrier removal member is provided opposed to an image bearing member at a position upstream of a developing position to remove the magnetic carrier before the magnetic carrier deposited on the image bearing member reaches the development position of the developing device in the next image forming step. However, with this counter-measurement, the magnetic carrier particles on the image bearing member may pass by the carrier removal member, and therefore, the removal of the magnetic carrier particles is not enough.

Japanese Patent Application Publication Hei 4 47825 proposes, as means for removing the magnetic carrier particles which have been undesirably introduced in the developing device.

A proposal has been made as to use of magnetic force as a means for removing the introduced magnetic carrier. For example, Japanese Laid-open Patent Application Hei 9 211989 discloses that magnetic carrier deposited on the developing sleeve of the one component developing device is removed from the developing sleeve using a permanent magnet or the like. Moreover, Japanese Laid-open Patent Application Hei 5 40406 discloses that point of zero magnetic field is provided on the developing sleeve by the magnetic pole structure in the developing sleeve to remove the magnetic carrier. Even if, however, these methods are used, the magnetic carrier once removed may be again caught by the developing sleeve, and the inventors thought that there was room for improvement.

In addition to the foregoing structure, there are various patterns of structures wherein, for example, a one component developing device and a two component developing device are both provided in the rotary developing device. It is difficult to effectively prevent the introduction of the magnetic carrier into the one component developing device by the disposition of the one component developing device and the two component developing device.

As for means for cleaning the image bearing member, there is a cleaning blade to remove the magnetic carrier before the magnetic carrier is introduced into the one component developing device, and the cleaning blade pressure is raised. However, with this method, vibration or turn-over of the cleaning blade may occur, or the edge of the cleaning blade may be damaged or broken.

SUMMARY OF THE INVENTION

Accordingly, it is a principal object of the present invention to provide a developing apparatus with image decrease of a density of an image provided by a first developing means due to deposition of the carrier on the image bearing member from a second developing means and introduction of the deposited carrier into the first developing means, is effectively prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
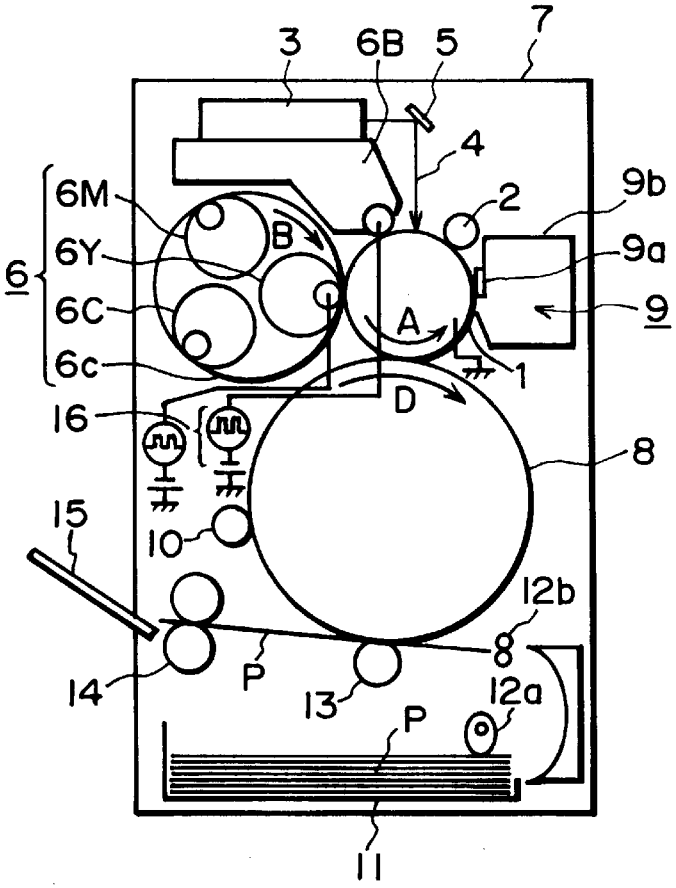
FIG. 1 is a schematic illustration of an image forming apparatus according to an embodiment of the present invention.
Figure 2:
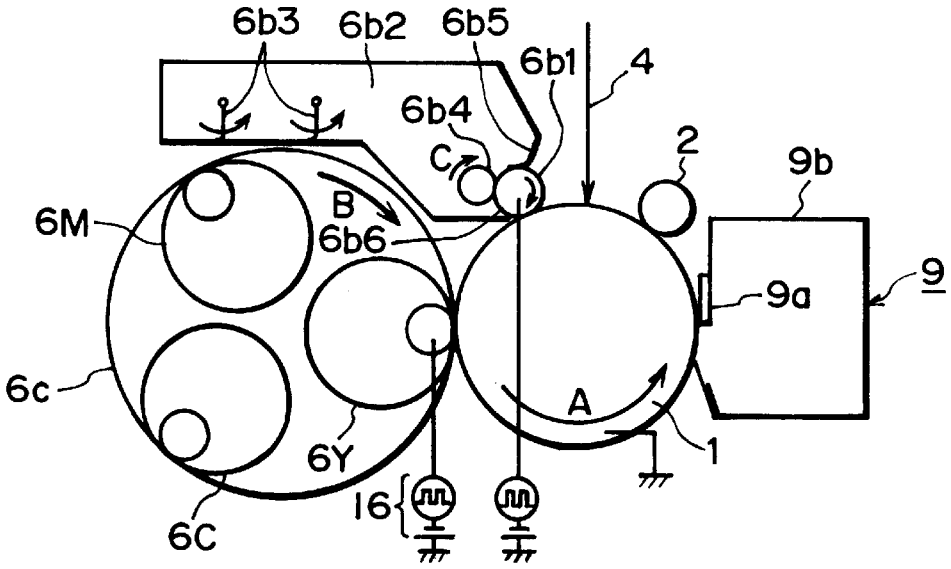
FIG. 2 is an enlarged schematic illustration of a major part of a developing device and parts thereon in the image forming apparatus shown in FIG. 1.

Referring to FIGS. 1 and 2, an image forming apparatus according to an embodiment of the present invention will be described. FIG. 1 is a general arrangement of the image forming apparatus, and FIG. 2 is a schematic illustration of the developing device and parts therearound.

The image forming apparatus according to this embodiment, as shown in FIG. 1, comprises an image bearing member 1, a charging roller 2 as a charging device for electrically charging the image bearing member 1, exposure means 3 as an image information writing apparatus for forming an electrostatic latent image on the surface of the image bearing member 1 having been electrically charged by the charging roller 2, a developing device 6 including four developing devices 6B, 6Y, 6M, 6C for visualizing the electrostatic latent images with developers, an intermediary transfer member 8 for receiving the toner image provided by the developing device 6 from the image bearing member 1, a cleaning device 9 for removing the matter deposited on the image bearing member 1 after the image transfer operation, a transfer roller 13 for transferring the toner image having been transferred onto the intermediary transfer member 8, onto a transfer material P such as plain paper, a cleaner 10 for removing the deposited manner from the intermediary transfer member 8 after the image transfer operation, and a fixing device 14 for fixing the toner image onto the transfer material P. In addition, the image forming apparatus comprises a sheet feeding system including a feeding cassette 11, a feeding roller 12*a*, a feeding roller 12*b* and a discharging tray 15 and the like.

The image bearing member 1 is an electrophotographic photosensitive member which comprises a cylindrical electroconductive base having an outer diameter of 50 mm and made of aluminum, for example, and a photosensitive layer of organic photosensitive material. In this embodiment, a protection layer is provided on the photosensitive layer to improve the parting property relative to the toner. The image bearing member 1 is rotatable in a direction indicated by an arrow A in FIG. 1 at a predetermined peripheral speed.

The image bearing member usable with the present invention is not limited to the photosensitive member 1, and may be any of known image bearing members. For example, it may be an amorphous silicon photosensitive member having a photosensitive layer of amorphous material comprising silicon atoms as a major component, for example.

The amorphous silicon photosensitive member may be a monolayer type amorphous silicon photosensitive member wherein the photosensitive layer is constituted by the photoconductive layer alone, or may be a multi-layer amorphous silicon photosensitive member comprising a charge injection blocking layer, a charge generation layer, a charge transfer layer, a buffer layer and a surface layer or the like. As means for improving the functions of the layers, various atoms may be introduced into the amorphous material. The surface layer may be of an amorphous carbon hydride structure comprising carbon atoms as the major component and hydrogen atoms. The amorphous silicon photosensitive member usable with the present invention can be manufactured by known various methods such as a plasma CVD method or the like.

The charging roller 2 is a contact charging device for electrically charging the image bearing member 1 while being in contact to the image bearing member 1, and it is a roller member comprising a core metal and an electroconductive elastic layer thereon. In the present invention, the charging device is not limited to a particular one, and may be any if it is capable of properly charging the image bearing member. The charging device may be in the form of a blade member, an electroconductive brush member, a magnetic brush member or the like (contact charging member), or it may be a discharge type charging apparatus such as a corona discharger or the like.

The exposure means 3 functions to generate a laser beam 4 modulated (ON/OFF) in accordance with the pixel signal indicative of image information inputted from an image signal generating device such as an unshown image reading apparatus, personal computer or the like through a print interface. In this embodiment, the laser beam generated by the exposure means 3 is reflected by the laser beam reflection mirror 5 toward the image bearing member 1 to scan the image bearing member 1. The present invention is not limited to this type, and may be replaced with another one depending on the quality of the image to be formed, the nature of the image bearing member, the developing system use or the like.

The developing device 6 comprises yellow toner developing means 6Y, magenta toner developing means 6M, cyan toner developing means 6C and a rotary supporting apparatus 6*c* for supporting these developing means, and black toner developing means 6B.

The rotary supporting apparatus 6*c* is supported on the main assembly 7 of the image forming apparatus for rotation in the direction of an arrow B in FIG. 1 to sequentially place the color toner developing means 6Y, 6M, 6C so as to oppose the image bearing member 1 at the developing position where the developing operations are carried out for the respective colors. The rotary supporting apparatus 6 and the developing means supported thereon is contained in a process cartridge detachably mountable relative to the main assembly 7 of the image forming apparatus, and when the developers in the color toner developing means 6Y, 6M, 6C are used up, the process cartridge is exchanged to permit further image forming operations.

The black toner developing means 6B accommodates a one component developer comprising black magnetic toner, the consumption of which is the greatest, and the black toner developing means 6B is detachably mounted in the main assembly 7 of the image forming apparatus. The black toner developing means 6B is disposed upstream of the color toner developing means with respect to the rotational direction of the image bearing member 1 and comprises a toner container 6*b*2, a developing sleeve 6*b*1 disposed rotatably in the opening of the toner container 6*b*2, a developing blade 6*b*5 as a regulating member for regulating a thickness of a layer of the developer applied on the developing sleeve 6*b*1, feeding means 6*b*3 for feeding the developer from the toner container 6*b*2 to the developing sleeve 6*h*1, a supplying roller 6*b*4 for supplying the developer fed out by the feeding means 5*b*3 to the developing sleeve 6*b*1, a blow-out preventing sheet 6*b*6 for preventing the blow-out of the developer to the outside from the lower portion of the toner container 6*b*2.

Figure 7:
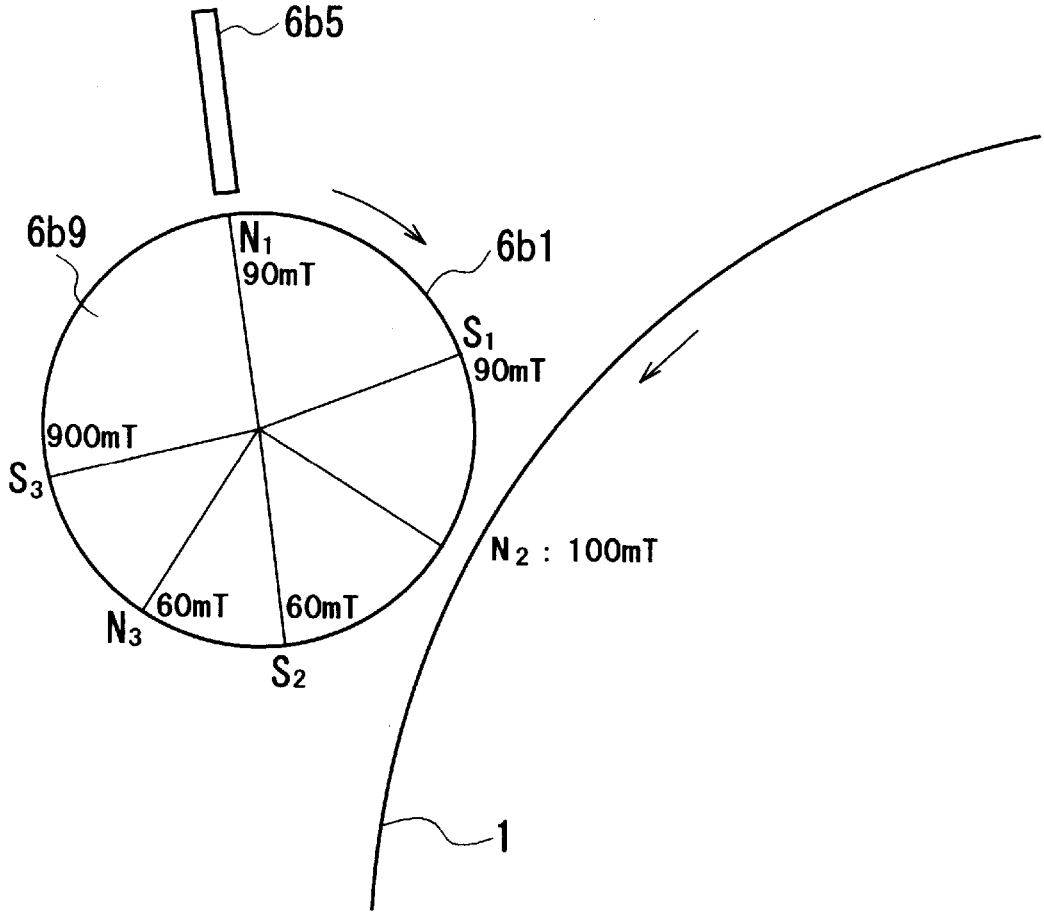
FIG. 7 shows details of non-contact type a developing device using a one component developer.

The developing sleeve 6*b*1 functioning as the developer carrying member is in the form of a cylindrical member of metal such as aluminum, stainless steel or the like which encloses a magnet 6*b*9 (magnetic field generating means) having magnetic poles N1N3, S1–S3 (the developing magnetic pole is N2) (FIG. 7). The developing blade 6*b*5 is an elastic blade of rubber material, for example, but it may be a magnetic blade which is out of contact with the developing sleeve 6*b*1. The supplying roller 6*b*4 is preferably made of a rubber foam material such as polyurethane silicone or the like. It is preferable that supplying roller 6*b*4 is contacted to the developing sleeve 6*b*1 and 1s rotated in the direction of rotation in FIG. 2 with a peripheral speed difference.

Figure 8:
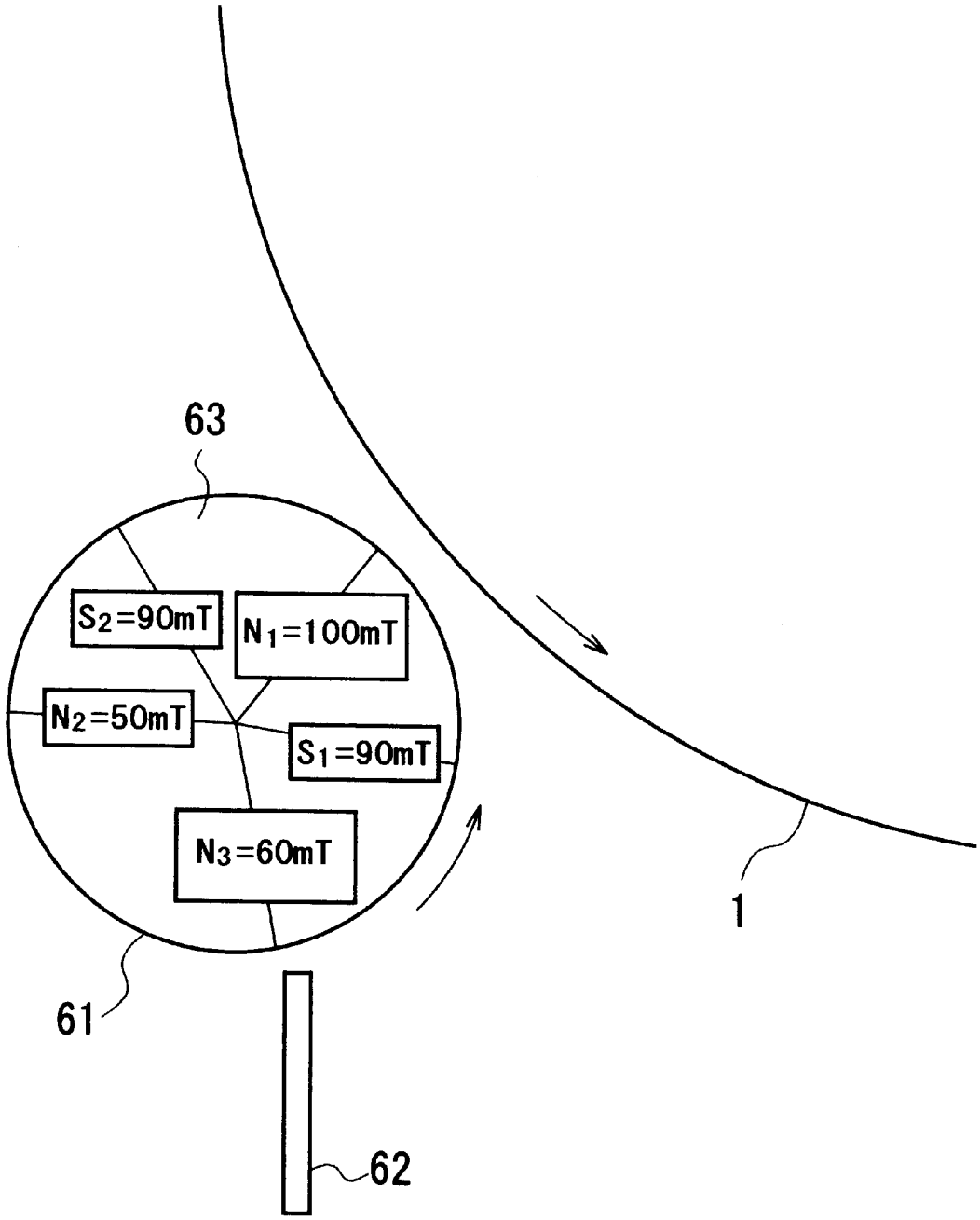
FIG. 8 shows details of a contact-type developing device using a two component developer.

In each of the color toner developing means 6Y, 6M, 6C, the peripheral moving directions of the developing sleeve 61 and the photosensitive member are is opposite to each other at the developing zones the distance between the magnetic blade 62 and the developing sleeve is properly selected, and the magnetic pole positioning and the magnetic fields of the magnetic poles N1–N3 (the developing magnetic pole is N1) and S1–S2 of the magnet 63 stationarily provided in the developing sleeve, so that magnetic brush formed on the developing sleeve is contacted to the image bearing member at the developing zone (FIG. 8).

The color toner developing means 6Y, 6M, 6C accommodates two component developers comprising magnetic carrier and non-magnetic toner. A thin layer of the magnetic carrier carrying the non-magnetic toner particles is magnetically formed into a brush on the developing sleeve by the magnet. The magnetic brush is contacted to the image bearing member 1 at a development position to develop the electrostatic latent image. The rotary supporting apparatus 6C functions to bring the respective color toner developing means to a common developing position by its rotation.

In the black toner developing means 6B, when it is mounted to the main assembly 7 of the image forming apparatus as shown in FIG. 2, a developing sleeve 6*b*1 is disposed with a small gap relative to the image bearing member 1 (50 $\mu$m–500 $\mu$m in this embodiment) to provide a developing zone where the magnetic toner is supplied to the image bearing member 1 from the developing sleeve 6*b*1.

The black toner developing means 6B accommodates the one component magnetic developer, in which a thin layer of the developer is formed on the developing sleeve in the form of a brush by a magnet. The developer is caused to jump to the image bearing member 1 by application of the alternating voltage (a voltage provided by superposing a DC voltage and an AC voltage) without contact of the magnetic brush to the image bearing member 1 (jumping development). The layer thickness of the developer is regulated by a blade (regulating member) such that developer on the developing sleeve is not directly contacted to the image bearing member at the developing position.

The image forming apparatus in this embodiment comprises a developing bias applying voltage source 16 to apply the alternating voltage in the developing operation of the black toner developing means 6B and the color toner developing means 6Y, 6M, 6C. The developing bias applying voltage source 16 is electrically connected such that developing sleeves of the respective developing devices are supplied with the developing bias.

In the image forming apparatus of this embodiment, when the toner image is toner image formed on the image bearing member 1 is transferred onto the transfer material P, the toner image is transferred onto the intermediary transfer member 8 from the image bearing member 1, and the image is transferred onto the transfer material P from the intermediary transfer member 8. This is preferable in order to form a color image without color misregistration. However, the present invention is not limited to such a two stage transfer, but is applicable to a system if it transfers the toner image from the image bearing member 1 ultimately onto a transfer material.

The intermediary transfer member 8 comprises a cylindrical electroconductive base of aluminum or the like, an electroconductive elastic layer of NBR rubber or the like in which electroconductive material such as carbon is dispersed, and a parting layer, on the electroconductive elastic layer, of urethane resin material in which carbon, fluorine resin material or the like is dispersed.

The above-described has a structure similar to the charging roller 2 described above, and comprises a core metal and an electroconductive elastic layer thereon. The transfer roller 13 may be coated with a parting layer for preventing deposition of the toner particle or the like, as desired.

The cleaning device 9 comprises a residual toner container 9*b* and a cleaning blade 9*a* is in the form of a plate-like elastic member contacted to the image bearing member 1, provided in an opening of the residual toner container 9*b*. The cleaning blade 9 functions to scrape the residual matter (toner particles, magnetic carrier and the like) from the surface of the image bearing member 1 after the toner image transfer from the image bearing member 1 onto the cleaning blade 9*a*.

As for the cleaning device 9 for the image bearing member 1, a cleaning blade 9*a* type made of elastic member such as rubber is widely used because the blade type cleaning device is simple in the structure and less costly. The material of the cleaning blade is ordinarily polyurethane rubber which is one of thermoplastic elastomers from the standpoint of an antiwearing property, mechanical strength and moldability.

Generally, in the cleaning device 9 having the cleaning blade 9*a*, cleaning blade 9*a* is press-contacted to the surface of the image bearing member 1 counterdirectionally. In the cleaning mechanism of this type, the cleaning blade 9*a* is press-contacted to pressure sufficient to remove the residual toner from the surface of the image bearing member 1 (5.40 gf/cm ($4.9\times10^{-}$-0.39N/cm)). The edge portion of the cleaning blade 9*a* closely contacted to the surface of the image bearing member is deformed by the frictional force relative to the image bearing member 1 (compression deformation), and the energy accumulated at the edge portion of the cleaning blade 9*a* resulting from the stress functions as a restoring force (repelling elastic force) with the result of a rebounding action. That is, a stick-slip motion is used.

Therefore, in order to provide a stabilized cleaning property in the cleaning device 9 using the cleaning blade 9*a*, it is desirable that amplitude and the frequency of the stick-slip motion are proper. The amplitude and the frequency of the stick-slip motion can be optimized by adjusting the frictional force between the edge portion of the cleaning blade 9*a* and the surface of the image bearing member, the configuration of the cleaning blade 9*a*, material properties of the cleaning blade 9*a*, Young's modulus, Poisson ratio, modulus (stress-stain curve).

The cleaner 10 functions to remove the toner remaining on the intermediary transfer drum 8 in this embodiment, it is in the form of an elastic roller member, but it may be any known blade member, a brush member or the like.

The fixing device 14 is a heat pressing fixing means comprising a heating roller and pressing roller, and it may any known fixing device. The fixing device 14 may be of any known type if it can fix the unfixed toner image on the transfer material P (film type, for example).

In the image forming apparatus, two kinds of developers are used. The developer accommodated in the black toner developing means 6B (achromatic developer) is a one component magnetic developer comprising at least magnetic toner particles. Color (chromatic) developers accommodated in the color toner developing means 6Y, 6M, 6C are two component non-magnetic developers, respectively, each of which comprises non-magnetic toner particles and magnetic carrier.

The detail of the developer will be described. In an external magnetic field of 79.58 kA/m which is substantially the same as the development magnetic field provided by the magnet functioning as the magnetic field generating means, the magnetization intensity $C\sigma_{1000}$ [$Am^2$/kg] of the magnetic carrier for the color developer and the magnetization intensity $M\sigma_{1000}$ [$Am^2$/kg] of the magnetic toner particles for the black developer satisfy:

$$30<C\sigma_{1000}<M\sigma_{1000}\times1.8$$

By this, when the magnetic carrier particles deposited onto the photosensitive member due to the rubbing from the two component developing means arrives at the developing position of the one component developing means, the magnetic carrier particles are effectively prevented from being introduced into the one component developing means, even if the intensity of the magnetization of the magnetic toner particles are so selected that magnetic toner particles are sufficiently reciprocated between the developing sleeve and the photosensitive member by the electric field force (alternating voltage) against the magnetic force in the one component developing means. Therefore, in the decrease of the image density provided by the one component developing means can be effectively prevented.

The peripheral surface of the image bearing member 1 is electrically charged by the charging roller 2 to the uniform predetermined potential (approximately −600V in this embodiment) of the predetermined polarity. The charged surface is exposed to scanning laser beam 4 produced from the exposure means 3, by which an electrostatic latent image corresponding to the image information is formed.

More particularly, the photosensitive member is scanned by the exposure means 3 which is ON/OFF-controlled in accordance with the image data of the first color (yellow, for example), so that electrostatic latent image of the first color (approx. −100V in this embodiment) is formed on the image bearing member 1. The first color electrostatic latent image is developed or visualized by the yellow toner developing means 6Y containing the yellow toner (first color) having the negative polarity. The visualized first toner image is transferred onto the surface of an intermediary transfer member 8 which is press-contacted to the image bearing member 1 with a predetermined pressure and which is rotating at the peripheral speed substantially the same as that of the image bearing member 1 (100 mm/s in this embodiment) in the direction indicated by an arrow D, at a nip formed therebetween.

In the transfer of the image onto the intermediary transfer member 8, the intermediary transfer member 8 is supplied with a voltage having a polarity opposite from the charging polarity (−) of the toner and having a predetermined level (+100V). The toner particles or the like remaining on the image bearing member 1 without being transferred onto the intermediary transfer member 8 are scraped by the cleaning blade 9*a* of the cleaning device 9 press-contacted to the image bearing member 1 and is collected into a residual toner container 9*b*.

The transfer step described above is repeated for the other toner (magenta, cyan and black) so that toner images are superimposed on the intermediary transfer member 8, by which the color image is formed. After the color image is developed, the black image is developed. This is preferable so that in the introduction of the black developer in the color image developing device can be prevented, and therefore, satisfactorily images can be formed for a long term.

While the toner image transfers onto the intermediary transfer member 8, a transfer material P is fed from the feeding cassette 11 by the feeding roller 12*a* and the feeding roller 12*b* into the nip between the intermediary transfer member 8 and the transfer roller 13. The transfer roller 13 functions to contact the transfer material P to the intermediary transfer member 8 and to apply a voltage (+100V) of the polarity opposite the toner to a rear surface of the transfer material P, so that toner image is transfer onto the transfer material P from the intermediary transfer member 8.

The transfer material P now having the transferred toner image is separated from the intermediary transfer member 8 as is fed into the fixing device 14. In the fixing device, the toner image is pressed and heated by the pressing roller and the heating roller, so that toner image is fixed on the transfer material P. The transfer material P on which the toner image has been fixed is discharged to the discharging tray 15. In the above-described image forming operation, during the developing operation by the color toner developing means, the magnetic carrier might be supplied onto the image bearing member 1 together with the non-magnetic toner particles. The magnetic carrier is removed by the cleaning blade 9*a*. However, as described in the introductory part of the specification, the magnetic carrier is not completely removed by the blade only. The magnetic carrier having passed by the blade only. The magnetic carrier having passed by the cleaning blade 9*a* reaches the developing zone of the black toner developing means. However, in the image forming apparatus of this embodiment, the magnetic carrier and the magnetic toner particle satisfy the above inequation, so that introduction of the unremoved magnetic carrier into the black toner developing means is suppressed so that good images can be formed without reduction of the image density for a long term.

These advantageous effects are provided also when the magnetization intensity $C\sigma s$ [$Am^2/kg$] of the magnetic carrier and the magnetization intensity $M\sigma s$ [$Am^2/kg$] satisfy the following under the external magnetic field of 795.8 kA/m:

$$35 < C\sigma s < M\sigma s \times 1.7$$

When $C\sigma 1000$ or $C\sigma s$ is smaller than the range, it is difficult to properly retain the magnetic carrier on the developing sleeve in the color toner developing means with the result of tendency of shortage of the magnetic carrier and/or scattering of the non-magnetic toner particles. If $C\sigma_{1000}$ is larger than 75, and $C\sigma s$ is larger than 80, the chains of the magnetic brush expand in the developing zone so that pressure against the photosensitive member or the latent image increases with a result of production of brushing trace. If the ranges ($M\sigma_{1000} \times 1.8$, $M\sigma s \times 1.7$) are exceeded, the magnetic carrier deposited on the image bearing member 1 in the color toner developing means is easily introduced into the black toner developing means 6B by the magnetic suction force toward the developing sleeve in the black toner developing means 6B, when such magnetic carrier reaches the developing zone of the black toner developing means 6B.

From this standpoint, it is preferable that $C\sigma_{1000}$ satisfy $30 < C\sigma_{1000} < M\sigma_{1000} \times 1.8 < 75$, and $C\sigma s$ satisfy $35 < C\sigma s < M\sigma s \times 1.7 < 80$. It is preferable that $C\sigma_{1000}$ is larger than 30 and not larger than 66. If the magnetization amount $M\sigma_{1000}$ of the magnetic toner is smaller than 20, $M\sigma s$, and 20, $M\sigma s$, and 40, $M\sigma s$ is larger than 45, the image defect attributable to toner movement before the heat fixing due to insufficient electrostatic attraction between the toner and the transfer material such as the paper because of the decrease of the charge amount of the magnetic toner. Therefore, $20 \leqq M\sigma_{1000} \leqq 40$ and $25 \leqq M\sigma s \leqq 46$ are preferable, and $20 \leqq M\sigma_{1000} \leqq 31$ and $25 \leqq M\sigma s \leqq 36$ are further preferable.

The intensity of the magnetization of the magnetic carrier and the magnetic toner particles are preferably major using an automatic magnetic property recorder of vibratory BHV 30 available from RIKEN DENSHI Kabushiki Kaisha, Japan. External magnetic fields of 79.58 kA/m, 795.7 kA/m are generated, and the intensities of the magnetization are determined in the following manner. The description will be made only with respect to the magnetization intensity of the magnetic carrier since the measurement is the same as with the magnetic toner particles.

The magnetization or the magnetic carrier is measured in the following manner. The magnetic carrier is filled into a cylindrical plastic resin material container so as to be packed at a sufficiently high density. With the state, a magnetization moment is measured, and the actual weight of the sample is measured, and the intensity of the magnetization ($Am^2/kg$) is determined. The true specific gravity of the magnetic carrier particles is determined using dry type automatic density meter Acupick 1330, available from SHIMAZU SEISAKUSHO Kabushiki Kaisha, Japan, for example. By multiplying the determined intensity of magnetization ($Am^2/kg$)by the true specific gravity, the intensity or magnetization per unit volume can be obtained.

A description will be made as to the developer usable with the present invention. The two component non-magnetic developer will first be described.

The two component non-magnetic developer usable with the present invention comprises non-magnetic toner particles and magnetic carrier particles. The non-magnetic toner particles may be known non-magnetic toner particles. In the case or color toner, known coloring materials in the form of coloring material, pigment and the like are usable. Such non-magnetic toner particles can be manufactured through a known method such as a suspension polymerization method, emulsifying polymerization method or another polymerization method or pulverization method or the like.

The non-magnetic toner particles having known preferable properties in the volume average particle size, the average circularity, the triboelectric charge amount and the like The properties can be properly adjusted by selecting the materials, the perception, the manufacturing method, the post-processing method and the like.

The magnetic carrier may be the known particles. For example, it may be a resin material carrier produced by dispersing magnetite as a magnetic material in resin material and further dispersing electroconductive material such as carbon black for providing electoral conductivity and adjusting the resistance, The resistance may be adjusted by oxidization or deoxidizalion treatment or the simple substance of the magnetite such as ferrite magnetite or by coating surfaces of the simple substance of magnetite such as ferrite with resin material. As to the manufacturing method of the magnetic carrier, known methods are usable.

Any known magnetic carriers are usable if the non-magnetic toner particles are properly retained thereon, the triboelectric charge amount is proper, and it is properly carried on the developing sleeve in the color toner developing means. The particles have proper properties in the average particle size, the magnetic particularly property, the resistivity and the like. The properties can be adjusted by known methods.

The magnetic carrier usable with the present invention preferably comprises magnetic material as the core material and resin material coating it from the standpoint of long service life of the magnetic carrier and from the stabilization of electric charging of the non-magnetic toner particle in view of the usage thereof, that is, the usage as one component of the two component non-magnetic developer. The magnetic carrier will be described in more detail.

The magnetic material may be surface oxidized or unoxidized iron, nickel, copper, zinc, cobalt, manganese, chromium, rare earth or the like metal, or alloy or oxide thereof. The manufacturing method may be a known one.

The coating resin material coating the surface of the magnetic material is properly selected from electrically insulative resin materials in consideration of the relation with the material of the non-magnetic toner particles and the material of the magnetic carrier core material. In the invention, in order to improve the adhesiveness relative to the surface of the carrier core material, it preferably comprises at least one monomer of acrylate (or ester thereof) monomer and methacrylate acid (or ester thereof) monomer.

Particularly when use is made of polyester resin material particle having a high negative charging power, as the material of the non-magnetic toner particles, it is preferable that it is a copolymer resin material with a styrene monomer from the standpoint of stabilization of electric charging. Furthermore, the copolymer resin material weight ratio of the styrene monomer is preferable approx. 5.70% by weight.

As for the method of coating the surface of the magnetic material, the coating material of the resin material or the like is dissolved or suspending in a solvent, and it is applied on the surface of the magnetic material, or the coating material in the form or powder is mixed there with.

The monomer usable as the coating resin material includes styrene monomer such as styrene monomer, chlorostyrene monomer, αmethylstyrene monomer, styrene-chlorostyrene monomer or the like; acrylic monomer such as esteracrylate monomer (methylacrylate monomer, ethylacrylate monomer, butylacrylate monomer, actylacrylate monomer, phenylacrylate monomer, 2 ethylhexyl acrylate monomer), ester methacrylate monomer (ethyl methacrylate monomer, ethyl methacrylate monomer, butyl methacrylate monomer, phenyl methacrylate monomer) or the like.

The one component magnetic developer will be described.

The one component magnetic developer usable with the present invention comprises at least magnetic toner particles. The magnetic toner particles comprise binder resin material, magnetic material and an additive or additive, as is known. The magnetic toner particles, similarly to non-magnetic toner particles, can be manufactured through a known polymerization method, pulverization method one like.

As to the magnetic toner particles, from the standpoint of formation of high image quality images, they have preferable properties in the volume average particle size, the magnetic particularity property, the average circularity, the charging particularly property, the degree of exposure of the magnetic material and the like. The properties can be adjusted properly using known method. The intensity of magnetization of the magnetic toner particles can be adjusted by known method, more particularly, by selecting the magnetic material, the perception, the dispersion state in the toner particles. The adjustment may be the same as with the magnetic carrier particles.

The one component augmented developer may comprise an externally added material, such as inorganic film particle for improvement in the flowability of the magnetic toner particles or electroconductive particles or the like for adjustment of the charging particularly property of the magnetic toner particles. The externally added material may be a known one or ones.

As described in the foregoing, according to this embodiment of the present invention, around the common image bearing member, there are provided developing means for effecting developing operation using a one component magnetic developer, and developing means for effecting developing operation using a two component non-magnetic developer, wherein the intensity of magnetization of the magnetic carrier and the intensity of magnetization of the magnetic toner particles satisfy the foregoing inequation, by which the image formation can be stabilized for a long term without density decrease due to introduction of the magnetic carrier into the developing means accommodating the one component magnetic developer (the black toner developing device 6B in the foregoing embodiment).

In the foregoing embodiment of the present invention, the developing means using the one component magnetic developer is disposed independently of the developing means using the two component non-magnetic developer. More particularly, the one component developing means is stationary, whereas the two component developing means is of a rotary type in which the two component developing means is carried on a developing rotary (supporting member), which is sequentially revolved, so that developer capacity of the developing means can be relatively freely selected, and the developing means containing the developer, black developer, for example, which is consumed more than the other developers may be given a larger capacity than the color toner developing means.

As described in the foregoing, in this embodiment, the color toner developing means is supported on a rotatable supporting member, and each of the developing means is placed selectively at the developing position by rotation of the rotatable supporting member. Because of the structure, it is not necessary to select the respective shapes of the developing means in consideration of the respective environments, us contrasted to the case in which the developing means are stationarily disposed around the image bearing member. The developing means can be sequentially operated for the developing means placed in the developing position by the rotation of the supporting member, and therefore, the developed device can be downsized. In other words, the space in the image forming apparatus can be more efficiently utilized.

In this embodiment, only one developing means is the one component developing means, but the present invention is not limited to particular numbers of the one component developing means and the two component developing means. Various known improvements with the respective to the dispositions of the plurality of a developing devices may be incorporated in this invention as long as the advantageous effects of the present invention are not influenced.

EXAMPLES

Example 1

In this example, the one component magnetic developer (black developer) is a so-called one component pulverized fine magnetic toner which is widely used and which comprises carbon black, magnetite or the like. The magnetic toner particles have a particular size of approximately 9 $\mu$m. The charge amount thereof is approximately −10 $\mu$C/g, and the magnetization intensity Mσs in the external magnetic field of 795.8 kA/m is 39 $Am^2$/kg, and the magnetization intensity $M\sigma_{1000}$ in the external magnetic field of 79.58 kA/m is 31 $Am^2$/kg.

The non-magnetic toner particles have a volume average particle size of approx. 8 $\mu$m. The non-magnetic toner particles were produced through a polymerization method. The toner particles are chargeable to the negative polarity, are externally added with silica and oxide titanium particles having an average particle size or approx. 20 nm.

The magnetic carrier has a number average particle size of 40 $\mu$m and a resistivity of $10^{13}$ Ωcm. As for the magnetic carrier, the preparation has been made with the particles having the magnetization intensities Cσs in the external magnetic field of 795.8 kA/m is 30 80 Am2/kg in 10 $Am^{2/kg}$ increments. Into the magnetic carriers of the respective magnetization intensities, non-magnetic toner particles (8% by weight on the basis of the total weight of the developer) is added to provide two component non-magnetic developers.

The measuring methods of the respective properties of the developer will be described.

Particle Size of the Toner Particles

As for the toner particles having an average particle size of not less than 3 $\mu$m, a laser scanning type particle size distribution measuring device, available from CIS100GALAI, was used, and the measurements or carried out for the range of 0.4 $\mu$m 60 $\mu$m. The sample for the measurement are prepared in the following manner. Into a liquid comprising 100 mL of water and 0.2 mL of a surfactant (alkyl benzene sulfonate), 0.5–2 mg of toner particles to be measured is added, and is dispersed by an ultrasonic dispersing device for 2 min. Thereafter, a cubic cell containing a magnet stirrer is prepared, and water is supplied thereinto to a level of 80 percent of the capacity thereof. One or two droplets of the sample having been subjected to the ultrasonic dispersion is added thereinto using pipet. The sample thus prepared is set on the measuring device, and the number average particle size and the volume average particle size of the toner particles are determined.

Average Particle Size of Magnetic Carrier

For the measurement of the particle size of the magnetic carrier, a scanning electron microscope (100–5000 times) is prepared. More than 300 of carrier particles having the particle size of −1 $\mu$m or larger are randomly extracted, and the horizontal ferr diameter is measured by an image processing analyzing apparatus Luzex 3 available from NIRECO KABUSHIKI KAISHA as the magnetic carrier particle size. On the basis of the results of the measurements, the number average particle size and the volume average particle size are calculated.

Resistivity of Magnetic Carrier or Core Particles (Magnetic Material)

The magnetic carrier or the core particles are filled into a cell. Then, an electrode is disposed contacted to the filled magnetic carrier or the core particles at each end of the field material. A voltage is supplied between the electrodes, and the electric current is measured. On the basis of the voltage and the current, the resistivity is determined. The measuring conditions of the resistivity in this embodiment are as follows: the contact area S between the electrode and the magnetic carrier or the core particles is approximately 2.3 $cm^2$; the thickness d is approximately 2 mm; the weight applied on the upper electrode is 180 g; and the measurement field intensity if 5×104V/m.

Measuring Method of Charge Amount of Magnetic Toner

Figure 6:
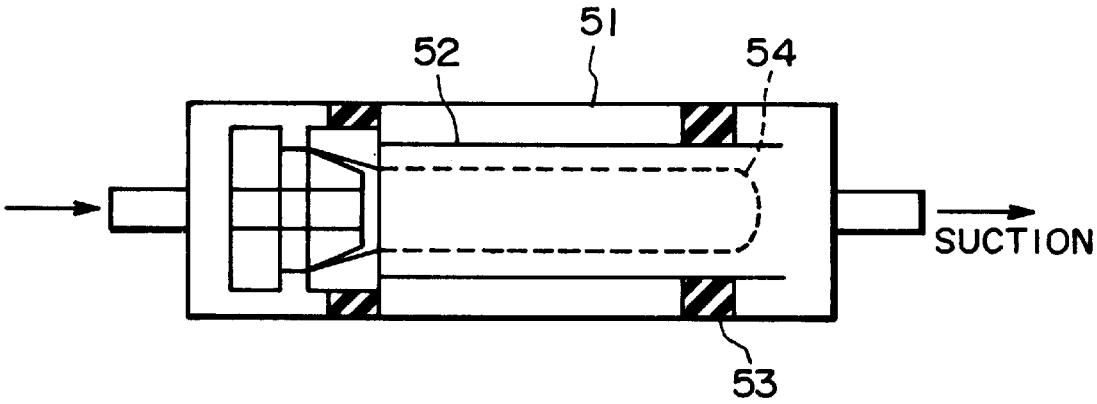
FIG. 6 is a schematic view of a machine for measuring a triboelectric charge amount of the magnetic toner.

The triboelectric charge amount of the magnetic toner (triboelectric charge) is measured using Faraday-Cage. The Faraday cage, as shown in FIG. 6, comprises an inner cylinder 52 of metal, the outer cylinder 51 covering the inner cylinder, and an insulating member 53 fixing the inner cylinder 52 in the outer cylinder 51. The inner cylinder 52 is provided with a filter 54 for collecting the magnetic toner. When an electrically charged object having an amount of electric charge Q is placed in the inner cylinder 52, the situation is as if there is a metal cylindrical having the amount of electric charge Q due to the electrostatic induction. The induced amount of electric charge is measured by a KEITHLEY 616 DIGITAL ELECTROMETER, and the triboelectric charge amount is determined as Q/M (the amount of electric charge Q divided by the weight M of the toner in the inner cylinder 52. The magnetic toner is supplied to the filter 54 directly from the developing sleeve by air suction.

Triboelectric Charge Amount of Non-Magnetic Toner Particle

Figure 5:
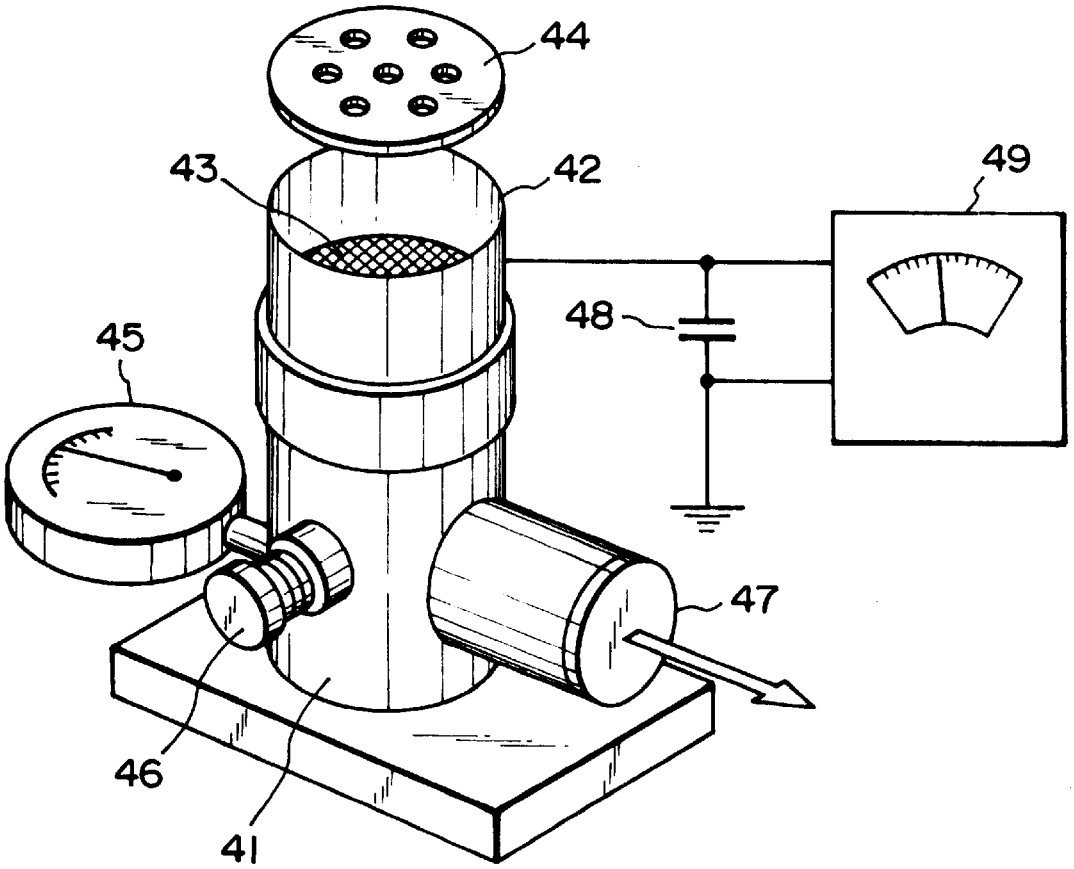
FIG. 5 is a schematic view of an apparatus for measuring a triboelectric charge amount of non-magnetic toner.

FIG. 5 illustrates a device for measuring a triboelectric charge amount of electric charge of non-magnetic toner particles. Into a polyethylene bin having a capacity of, 50100 mL, two component developer to be measured is supplied, and is manually shaken for about 10–40 sec. Approximately 0.5 1.5 g of the shaken sample is placed in a metal measurement container 42 having a 500 mesh screen 43 at the bottom, and then the measurement container 42 is close with a metal cap 44. The weight of the entirety of the measurement container 42 is measured (W1 (kg)).

Then, it is sucked by a suction machine 41 (at least a portion thereof contactable to the measurement container 42 is made or insulation material) from the suction opening 47, while the pressure detected by the vacuum meter 45 is maintained to be 250 mmAq (approx. 2.4 kPa) by adjusting the airflow control valve 46. In the state, the sucking operation continuous sufficiently, preferably for 2 min. To remove the resin material. The read of the potentiometer 49 is V (Volt). Designated by reference numeral 48 is a capacitor which has a capacity C (F). The weight of the entirety of the measurement container 42 after the suction is measured W2 ((kg)). The triboelectric charge amount is contracted from the results of measurements as follows:

$$\text{Triboelectric charge amount } (C/g)=(C\times V)/(W1-W2)$$

Figure 3:
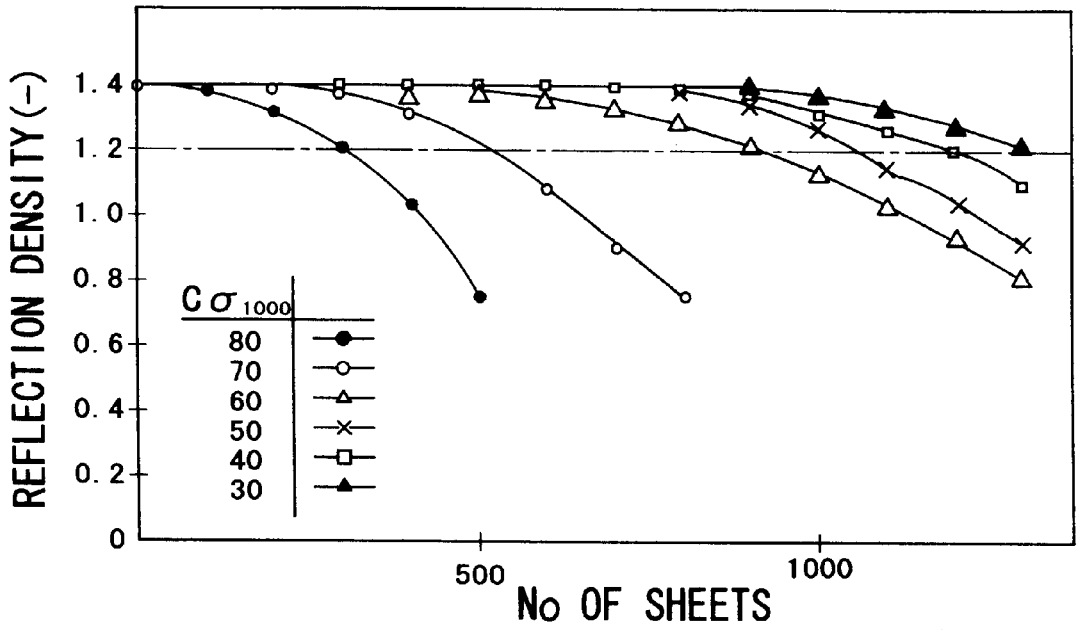
FIG. 3 shows an interrelation between an intensity of magnetization of magnetic carrier and an image density.

The magnetic toner particles, the non-magnetic toner particles and the magnetic carrier are used for the respective developers, which are incorporated in the image forming apparatus shown in FIGS. 1 and 2. Full-color image forming operations are carried out continuously at an image ratio of 5%. Periodically, the image density in the monochromatic black images are measured to assess the change of the black image density with the integrated number of image formations. The Initial reflection density is 1.4. In the assessment, the limited is set at the reflection density of 1.2. The reflection density of the images are carried out using densimeter 941 available from Xrite. Table 1 shows the numbers of the sheets at which the limit is reached, and the $C\sigma_{1000}$, CσS of the magnetic carrier. FIG. 3 shows a change of the density of the black image relative to the number of image formations.

In this embodiment, the used black toner developing means has a high durability (1,000,000 sheets without maintenance). Therefore, in the assessment, the developer is satisfactory if the density limit number in the Table exceeds 1.000,000 sheets.

TABLE 1

| $C\sigma_{1000}$ | Cσ' | Limit No. Of sheets |
|---|---|---|
| 80 | 96 | 300,000 |
| 70 | 84 | 500,000 |
| 60 | 72 | 900,000 |
| 50 | 60 | 1,050,000 |

TABLE 1-continued

| $C\sigma_{1000}$ | Cσ' | Limit No. Of sheets |
|---|---|---|
| 40 | 48 | 1,200,000 |
| 30 | 36 | 1,350,000 |

As will be understood from the table, with the decrease of the intensity or the magnetization of the magnetic carrier, the density limit number increases. Specifically, from about 50 $Am^2/kg$ or $C\sigma_{1000}$, the density limit number exceeds 1,000,000 which is the target.

Therefore, in the image forming apparatus of this embodiment, it is preferable that magnetization intensity $C\sigma_{1000}$ of the magnetic carrier is not more than approximately 55, and that Cσs is not more than approximately 66, in order to avoid early stage image density decrease and to accomplish a long term stabilized image formation.

If the intensity $C\sigma_{1000}$ of the magnetic carrier is smaller than 30 $Am^2/kg$, it becomes difficult to properly retain the non-magnetic toner particles and the magnetic carrier on the developing sleeve with the result that deposition of the magnetic carrier onto the developing sleeve and the scattering of the non-magnetic toner particles from the developing device become significant. Therefore, the magnetization intensity of the magnetic carrier is not less than 30 in $C\sigma_{1000}$ and not less than 35 in Cσs.

Figure 4:
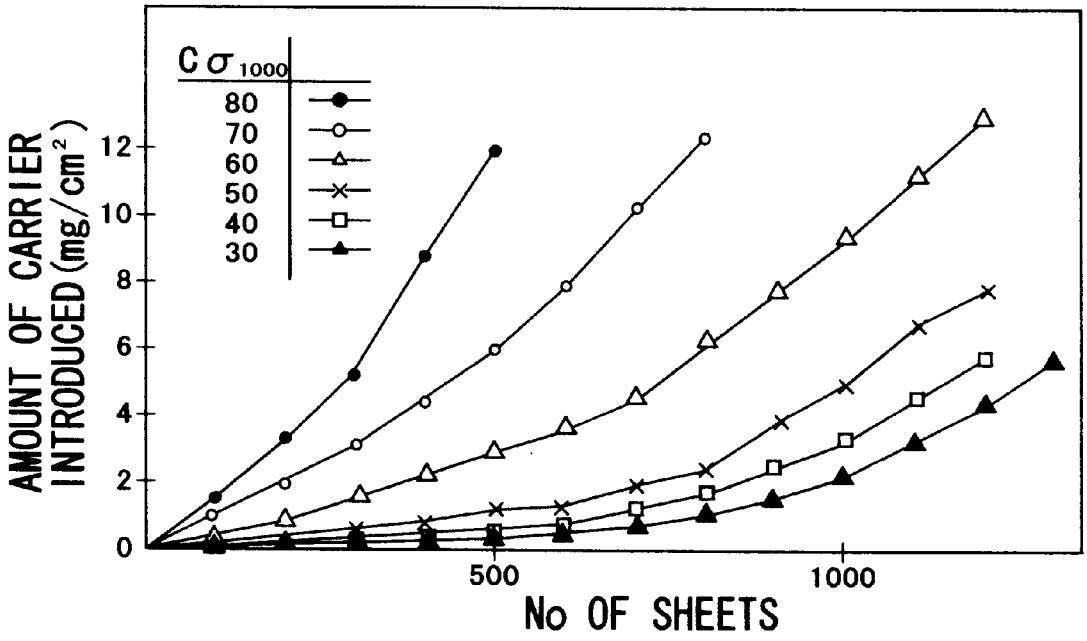
FIG. 4 shows an interrelation between a number of image formations and introduction of the magnetic carrier into a one component developing device.

The inventors have further made the following is comparisons and investigations. First, the magnetic toner is removed from the black developing device shown in FIG. 2 to permit the amount of the magnetic carrier introduced in the one component developing device. Then, similarly to the foregoing investigations, full-color images are continuously formed with an image ratio or 5%, and an amount or the magnetic carrier per unit area trapped on the developing sleeve of the one component developing means is periodically measured. FIG. 4 is a Table of a deposition amount of the magnetic carrier vs. number of image formations, for respective magnetization intensities of the magnetic carrier.

As will be understood from FIG. 4, with the decrease of the magnetization intensities of the magnetic carrier, the amount of the magnetic carrier introduced in the one component developing device decreases. Accordingly, it is considered that phenomenon represented in FIG. 3 and Table 1 is provided by the event that amount of the magnetic carrier introduced in the one component developing device decreases by the decrease of the magnetization intensity of the magnetic carrier, so that apparent toner amount M/S on the sleeve of the one component developing means (the weight of the toner per unit area of the developing sleeve) is prevented from decreasing.

It is further considered that when the magnetic carrier deposited on the image bearing member in the two component a developing device is carried to the one component developing device by the rotation of the image bearing member, the magnetic carrier is transferred from the image bearing member onto the developing sleeve of the one component developing device by the magnetic attraction force toward the developing sleeve if the magnetization intensity of the magnetic carrier is large. Table 1 shows that when the intensity of magnetization $C\sigma_{1000}$ of the magnetic carrier is not less than 55, the magnetic carrier is introduced into the one component developing the device by the magnetic suction force of the developing sleeve of the one component developing means; but, if the intensity $C\sigma_{1000}$ is not more than 55, the depositing force between the magnetic carrier and the suction force (the mirror force to the image bearing member provided by the charge amount of the magnetic carrier per se, for example) exceeds the magnetic attraction force, and therefore, the magnetic carrier is not incorporated in the one component developing device. The magnetic carrier not introduced into the one component a developing device returns to the two component developing device with the rotation of the image bearing member of FIG. 1 and is then caught by the two component developing device of a contact development type.

In this embodiment, the one component magnetic toner has been produced through a pulverization method and has intensities $M\sigma s=39$ $Am^2/kg$ and $M\sigma_{1000}=31$ $Am^2/kg$. Therefore, there are various magnetization intensities of the magnetic toner. However, the respective of the magnetization intensities of the magnetic toner, the density the decrease attributable to the magnetic carrier introduction can be avoided if the magnetization intensity of the magnetic carrier is enough to be carried on the developing sleeve and if the magnetization intensity of the magnetic carrier for the two component developer which is simultaneously used satisfy the one inequality (1) or (2) as follows:

$$C\sigma_{1000}<M\sigma_{1000}\times 1.8 \quad (1)$$

$$C\sigma s<M\sigma s\times 1.7 \quad (2)$$

In this embodiment, the one component magnetic toner is a pulverized type, but it may be produced through another method, for example, a polymerization method.

As described in the foregoing, in the case that black toner is the one component magnetic toner, and the yellow, magenta and cyan toner are two component non-magnetic developer, the stabilized image formation can be accomplished without density reduction attributable to the introduction of the magnetic carrier particles, by selecting the magnetic carrier so as to satisfy inequality (1) or (2) as follows:

$$C\sigma_{1000}<M\sigma_{1000}\times 1.8 \ldots ? \quad (1)$$

$$C\sigma s<M\sigma s\times 1.7 \quad (2)$$

Embodiment 2

The description will be made as to a second Embodiment in which the image bearing member 1 an amorphous silicon photosensitive member. In this embodiment, the image bearing member is an amorphous silicon photosensitive member which is chargeable to the positive polarity, and the image exposure is BAE (Background Area Exposure).

BAE is widely used in image forming apparatuses of analog type such as copying machines or the like, as is well-known. In the BAE, the image light portion (white portion) has a potential V1, and the image dark portion (black portion) has a potential Vd (¦Vd¦>¦V1¦). The BAE system is usable not only in the analog type but in a digital type as well. In the system, the absolute value of the potential of the background area is lowered by the laser beam projection or the like. Therefore, in this embodiment, a regular development is used in which the toner charged to the polarity opposite the polarity of the image bearing member with a developing bias voltage of Vm in the average.

The image forming process is substantially the same as in the preceding embodiment, and therefore, the detailed description is omitted for simplicity.

The amorphous silicon photosensitive member has a high durability (not less than 500 million sheets, and therefore, it is suitable for a high speed machine. It has been confirmed that advantageous effects provided by Embodiment 1 and shown in Table 1 and FIG. 3 are provided when the amorphous silicon photosensitive member is used.

Therefore, in the case that amorphous silicon photosensitive member is used, the same advantageous effects are provided, that is, in the case that black toner is the one component magnetic toner, and the yellow, magenta and cyan toner are two component non-magnetic developer, the stabilized image formation can be accomplished without density reduction attributable to the introduction of the magnetic carrier particles, by selecting the magnetic carrier so as to satisfy inequations (1) or (2) of Embodiment 1.

Even if the intensity of the magnetization of the magnetic toner particles are so selected that development is satisfactorily in a one component developing device, the magnetic carrier is prevented from entering the one component developing device by the magnetic force. Therefore, satisfactory images can be stably provided for a long term in the one component developing device.

While the invention has been described with reference to the structures disclosed herein, it is not confined to the details set forth and this application is intended to cover such modifications or changes as may come within the purpose of the improvements or the scope or the following claims.

What is claimed is:

1. A developing apparatus comprising:

first developing means for developing a latent image formed on an image bearing member with a first developer comprising a magnetic toner, said first developing means including a first developer carrying member for carrying and feeding the first developer to the image bearing member and first magnetic field generating means disposed in said first developer carrying member; and second developing means for developing a latent image formed on the image bearing member with a second developer comprising a magnetic carrier and a non-magnetic toner while the second developer contacts the image bearing member, said second developing means including a second developer carrying member for carrying and feeding the second developer to the image bearing member and second magnetic field generating means disposed in said second developer carrying member, wherein a magnetization intensity $M\sigma$ ($Am^2/kg$) of the magnetic toner in an external magnetic field of 795.8 (kA/m) and a magnetization intensity $C\sigma$ ($Am^2/kg$) of the magnetic carrier in the same external magnetic field, satisfy the following inequalities:

$$35<C\sigma(Am^2/kg)<M\sigma(Am^2/kg)\times 1.7.$$

2. An apparatus according to claim 1, wherein the following inequalities are satisfied:

$$35<C\sigma(Am^2/kg)<M\sigma(Am^2/kg)\times 1.7<80.$$

3. An apparatus according to either claim 1 or 2, wherein in the external magnetic field of 795.8 (kA/m), the following inequalities are satisfied:

$$35<C\sigma\leqq 66.$$

4. An apparatus according to claim 3, wherein in the external magnetic field of 795.8 (kA/m), the following inequalities are satisfied:

$$25\leqq M\sigma\leqq 46.$$

5. An apparatus according to either claim 1 or 2, wherein in the external magnetic field of 795.8 (kA/m), the following inequalities are satisfied:

$$25 \leqq M\sigma \leqq 46.$$

6. An apparatus according to claim 1, wherein during a developing operation, said first developer carrying member is supplied with a DC voltage biased with an AC voltage.

7. An apparatus according to either claim 1 or 6, wherein during a developing operation, said second developer carrying member is supplied with a DC voltage biased with an AC voltage.

8. A developing apparatus comprising:

first developing means for developing a latent image formed on an image bearing member with a first developer comprising a magnetic toner, said first developing means including a first developer carrying member for carrying and feeding the first developer to the image bearing member and first magnetic field generating means disposed in said first developer carrying member; and second developing means for developing a latent image formed on the image bearing member with a second developer comprising a magnetic carrier and a non-magnetic toner while the second developer contacts the image bearing member, said second developing means including a second developer carrying member for carrying and feeding the second developer to the image bearing member and second magnetic field generating means disposed in said second developer carrying member;

wherein a magnetization intensity $M\sigma'$ ($Am^2/kg$) of the magnetic toner in an external magnetic field, which is a development magnetic field provided by said first magnetic field generating means and a magnetization intensity $C\sigma'$ ($Am^2/kg$) of the magnetic carrier in an external magnetic field which is a development magnetic field provided by said second magnetic field generating means, satisfy the following inequalities:

$$30 < C\sigma'(Am^2/kg) < M\sigma'(Am^2/kg) \times 1.8.$$

9. An apparatus according to claim 8, wherein the following inequalities are satisfied:

$$30 < C\sigma'(Am^2/kg) < M\sigma'(Am^2/kg) \times 1.8 < 75.$$

10. An apparatus according to either claim 8 or 9, wherein in the external magnetic field, which is the developing magnetic field provided by said second magnetic field generating means, the following inequalities are satisfied:

$$30 < C\sigma' \leqq 55.$$

11. An apparatus according to claim 10, wherein in the external magnetic field, which is the developing magnetic field provided by said first magnetic field generating means, the following inequalities are satisfied:

$$20 \leqq M\sigma' \leqq 40.$$

12. An apparatus according to either claim 8 or 9, wherein in the external magnetic field, which is the developing magnetic field provided by said first magnetic field generating means, the following inequalities are satisfied:

$$20 \leqq M\sigma' \leqq 40.$$

13. An apparatus according to claim 8, wherein during a developing operation, said first developer carrying member is supplied with a DC voltage biased with an AC voltage.

14. An apparatus according to either claim 8 or 13, wherein during a developing operation, said second developer carrying member is supplied with a DC voltage biased with an AC voltage.

15. A developing apparatus comprising:

first developing means for developing a latent image formed on an image bearing member with a first developer comprising a magnetic toner, said first developing means including a first developer carrying member for carrying and feeding the first developer to the image bearing member and first magnetic field generating means disposed in said first developer carrying member; and second developing means for developing a latent image formed on the image bearing member with a second developer comprising a magnetic carrier and a non-magnetic toner while the second developer contacts the image bearing member, said second developing means including a second developer carrying member for carrying and feeding the second developer to the image bearing member and second magnetic field generating means disposed in said second developer carrying member, wherein a magnetization intensity $M\sigma$ ($Am^2/kg$) of the magnetic toner in an external magnetic field of 795.8 (kA/m) and a magnetization intensity $C\sigma$ ($Am^2/kg$) of the magnetic carrier in the same external magnetic field, satisfy the following inequality:

$$C\sigma(Am^2/kg) < M\sigma(Am^2/kg) \times 1.7.$$

16. A developing apparatus comprising:

first developing means for developing a latent image formed on an image bearing member with a first developer comprising a magnetic toner, said first developing means including a first developer carrying member for carrying and feeding the first developer to the image bearing member and first magnetic field generating means disposed in said first developer carrying member; and second developing means for developing a latent image formed on the image bearing member with a second developer comprising a magnetic carrier and a non-magnetic toner while the second developer contacts the image bearing member, said second developing means including a second developer carrying member for carrying and feeding the second developer to the image bearing member and second magnetic field generating means disposed in said second developer carrying member, wherein a magnetization intensity $M\sigma'$($Am^2/kg$) of the magnetic toner in an external magnetic field, which is a development magnetic field provided by said first magnetic field generating means and a magnetization intensity $C\sigma'$($Am^2/kg$) of the magnetic carrier in an external magnetic field, which is a development magnetic field provided by said second magnetic field generating means, satisfy the following inequality:

$$C\sigma'(Am^2/kg) < M\sigma'(Am^2/kg) \times 1.8.$$

* * * * *

UNITED STATES PATENT AND TRADEMARK OFFICE

CERTIFICATE OF CORRECTION

PATENT NO. : 6,650,858 B2
DATED : November 18, 2003
INVENTOR(S) : Yuji Bessho

It is certified that error appears in the above-identified patent and that said Letters Patent is hereby corrected as shown below:

Title page,
Item [57], ABSTRACT,
Line 9, "develops" should read -- which develops --.

Column 1,
Line 40, "59 2056" should read -- 59-2056 --;
Line 50, "4 47825" should read -- 4-47825 --;
Line 56, "9" should read -- 9- --; and
Line 61, "5 40406" should read -- 5-40406 --.

Column 8,
Line 49, "66." should read -- 55 and that Cσs is larger than 35 and not larger than 66. --;
Line 51, "Mσs, and 40," should read -- Mσs is smaller than 25, the foggy background tends to appear. On the other hand, if $M\sigma_{1000}$ is larger than 40, -- and "45," should read -- 46, --; and
Line 57, "36" should read -- 39 --.

Column 9,
Line 21, "or" should read -- of --; and
Line 30, "like" should read -- like. --.

Column 10,
Line 12, "preferable approx." should read -- preferably approximately -- ; and
Line 36, "one" should read -- or the --.

Column 11,
Line 25, "us" should read -- as --;
Line 37, "the respective" should read -- respect --;
Line 38, "a" should be deleted;
Line 56, "approx." should read -- approximately --;
Line 60, "or" should read -- of -- and "aprox." should read -- approximately --; and
Line 65, "is 30 80" should read -- is 30 - 80 --.

Column 12,
Line 2, "is" should read -- are --;
Line 12, "or" should read -- were --;
Line 14, "are" should read -- was --;
Line 17, "is" (both occurrences) should read -- are --;
Line 22, "is" should read -- are --; and
Line 53, "if" should read -- is --.

UNITED STATES PATENT AND TRADEMARK OFFICE

CERTIFICATE OF CORRECTION

PATENT NO. : 6,650,858 B2
DATED : November 18, 2003
INVENTOR(S) : Yuji Bessho

It is certified that error appears in the above-identified patent and that said Letters Patent is hereby corrected as shown below:

Column 13,
Line 17, “0.5 1.5” should read -- 0.5 - 1.5 --;
Line 20, “close” should read -- closed --;
Line 24, “or” should read -- of --;
Line 28, “continuous” should read -- continues -- and “2 min. To” should read -- 2 min. to --;
Line 46, “Initial” should read -- initial --; and
Line 47, “limited” should read -- limit --.

Column 14,
Line 34, “or” should read -- of --.

Column 15,
Line 14, “the respective” should read -- irrespective --; and
Line 43, “an” should read -- is an --.

Signed and Sealed this

Thirteenth Day of July, 2004

JON W. DUDAS
*Acting Director of the United States Patent and Trademark Office*